US006736184B2

(12) United States Patent
Eaton

(10) Patent No.: US 6,736,184 B2
(45) Date of Patent: May 18, 2004

(54) MOTORIZED REEL SYSTEM FOR WINDOW COVERING

(76) Inventor: Dean M. Eaton, 7275 Sylvan Ct., Sanford, FL (US) 32771

( * ) Notice: Subject to any disclaimer, the term of this patent is extended or adjusted under 35 U.S.C. 154(b) by 0 days.

(21) Appl. No.: 10/213,724

(22) Filed: Aug. 6, 2002

(65) Prior Publication Data

US 2004/0026047 A1 Feb. 12, 2004

(51) Int. Cl.[7] ..... A47H 5/00

(52) U.S. Cl. ..... 160/84.02; 160/84.01; 160/84.04; 160/168.1 R

(58) Field of Search ..... 160/84.01, 84.02, 160/84.04, 84.05, 168.1 R, 170 R, 171 R, 265

(56) References Cited

U.S. PATENT DOCUMENTS

| | | | | |
|---|---|---|---|---|
| 1,801,911 A | | 4/1931 | Duncanson | |
| 1,808,455 A | | 6/1931 | Duncanson | |
| 1,894,833 A | | 1/1933 | Ruby et al. | |
| 1,978,152 A | | 10/1934 | Ward | |
| 3,141,497 A | | 7/1964 | Griesser | |
| 3,310,099 A | | 3/1967 | Hunter et al. | |
| 3,603,372 A | | 9/1971 | Dietzsch | |
| 3,965,960 A | * | 6/1976 | Massey | 160/295 |
| 4,726,410 A | | 2/1988 | Fresh | |
| 4,817,698 A | * | 4/1989 | Rossini et al. | 160/107 |
| 5,184,660 A | | 2/1993 | Jelic | |
| 6,158,494 A | | 12/2000 | Huang | |
| 6,230,784 B1 | | 5/2001 | Sanz et al. | |
| 2002/0185001 A1 | * | 12/2002 | Hoogen et al. | 92/107 |
| 2003/0075283 A1 | * | 4/2003 | Collett et al. | 160/84.02 |

* cited by examiner

*Primary Examiner*—Bruce A. Lev
(74) *Attorney, Agent, or Firm*—Edward M. Livingston

(57) ABSTRACT

A motorized reel system for window covering has a reel-system case (1) with a length for being extended between opposite sides of a window frame (2). The reel-system case encloses a reel motor (3) in a first end and a shaft housing (7) in a second end. The reel motor is attached to a motor mount (4) having a reel slide (6) in which a first end of a reel (8) that is shaft-like slides linearly in one direction while the reel is also winding lift line (11, 12). The reel slides linearly in an opposite direction while unwinding the lift line. Linear sliding of the reel while also winding and unwinding the lift line is caused by rotation of external threads (9) in matching-thread contact with internal threads (10) in a threaded housing. Linear travel of the reel while it is being rotated spreads windings of the lift line evenly along the reel. This prevents overlapping and bunching of one or more lift lines being reeled onto and off of the reel while raising and lowering bottom ends (13) of window shade, curtain Venetian-like blinds or other window covering (14) having pleating or other foldable features. The external threads and the internal threads can be in either end of the reel.

32 Claims, 6 Drawing Sheets

MOTORIZED REEL SYSTEM FOR WINDOW COVERING

BACKGROUND OF THE INVENTION

This invention relates to reels for winding and unwinding line for lowering and raising window shades, curtains and blinds without entanglement of the line.

A conventional practice of raising and lowering horizontally pleated shades, curtains and Venetian-like blinds on shaft-like reels has been fraught with problems of entanglement and bunching of the line by minor interferences. There are known devices and methods for preventing line entanglement and bunching but not with a simple and effective line-reeling controller in relationship to select shades, curtains and blinds in a manner taught by this invention.

There is no known screw-threaded reel for linear actuation to prevent bunching in a manner taught by this invention.

Examples of most-closely related known but different devices are described in the following patent documents:

| U.S. Pat. No. | Inventor | Issue date |
|---|---|---|
| 4,726,410 | Fresh | Feb. 23, 1988 |
| 1,978,152 | Ward | Oct. 23, 1934 |
| 1,801,911 | Duncanson | Apr. 21, 1931 |
| 3,310,099 | Hunter, et al. | Mar. 21, 1967 |
| 3,141,497 | Griesser | Jul. 21, 1964 |
| 6,230,784 | Sanz, et al. | May 15, 2001 |
| 6,158,494 | Huang | Dec. 12, 2000 |
| 3,603,372 | Dietzsch | Sep. 07, 1971 |
| 1,894,833 | Ruby, et al. | Jan. 17, 1933 |
| 1,808,455 | Duncanson | Jun. 02, 1931 |

SUMMARY OF THE INVENTION

Objects of patentable novelty and utility taught by this invention are to provide a motorized reel system for window covering which:

- is reliably operative;
- does not cause reel lines or strings to slide toward tapered ends as for present tapered reels;
- can be used for unusually small-to-large sizes of shades;
- prevents strings from becoming entangled;
- can be used on a wide variety of lengths and sizes of reel-rail heads;
- can use a wide variety of motors; and
- does not need a duplicate mounting bracket.

This invention accomplishes these and other objectives with a motorized reel system for window covering having a reel case with a length for reaching between opposite sides of a window frame. The reel case encloses a reel motor in a first end and a reel housing in a second end. The reel motor is attached to a motor base having a reel slide in which a first end of a shaft-like reel slides linearly in one direction while the shaft-like reel is also winding lift line. The shaft-like reel slides linearly in the opposite direction while the shaft-like reel is unwinding the lift line. Linear sliding of the shaft-like reel while also winding and unwinding the lift line is caused by rotation of outside-diameter threads in a second end of the shaft-like reel that match inside-diameter threads in the reel housing. Linear travel of the shaft-like reel while it is being rotated prevents overlapping and bunching of one or more lift lines being reeled onto and off of the shaft-like reel while raising and lowering bottom ends of window shade, curtain Venetian-like blinds or other window covering having pleating or other foldable features.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
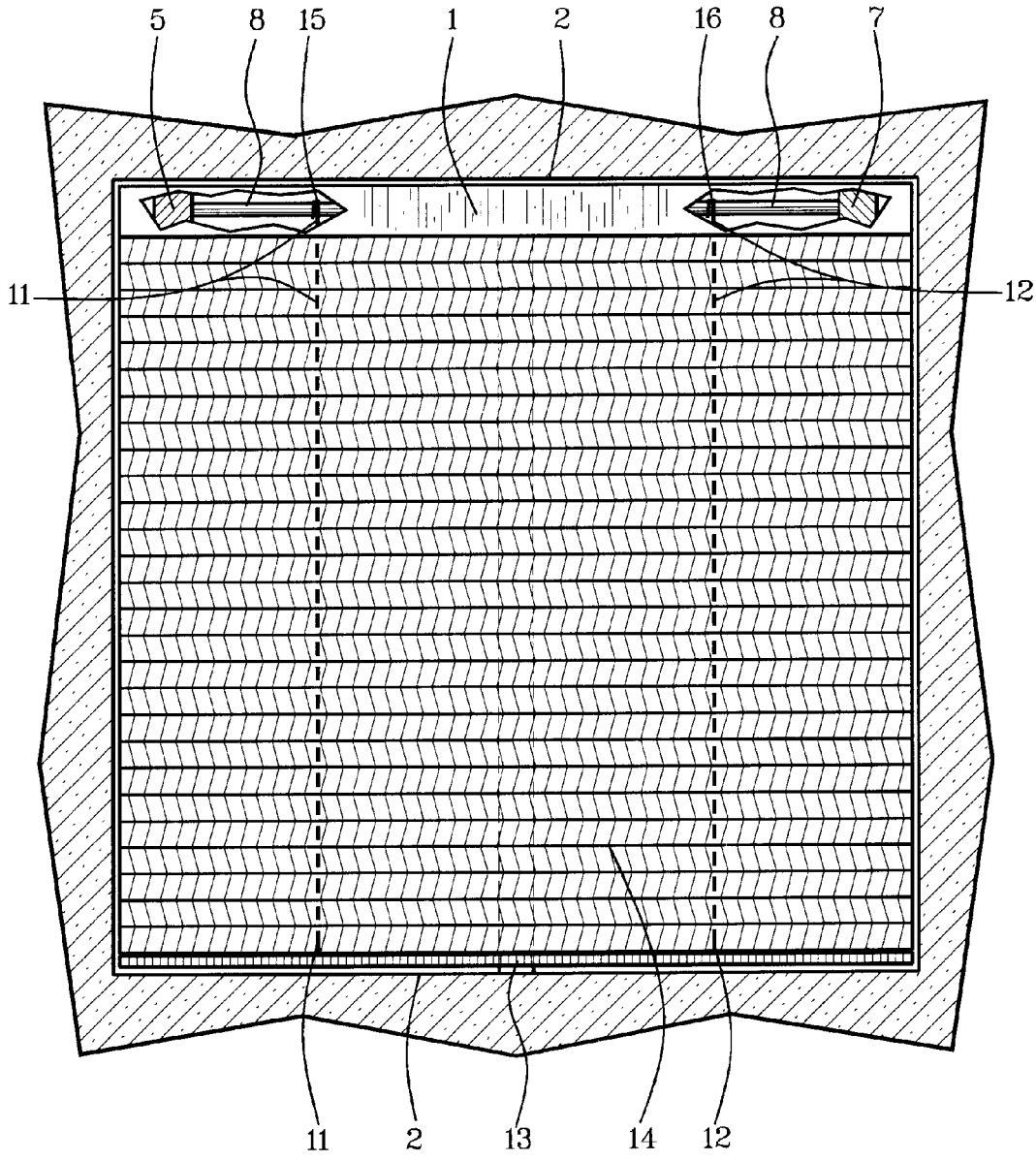
FIG. 1 is a partially cutaway front elevation view of the motorized reel system for window covering that is a horizontally pleated window shade in a lowered mode.
Figure 2:
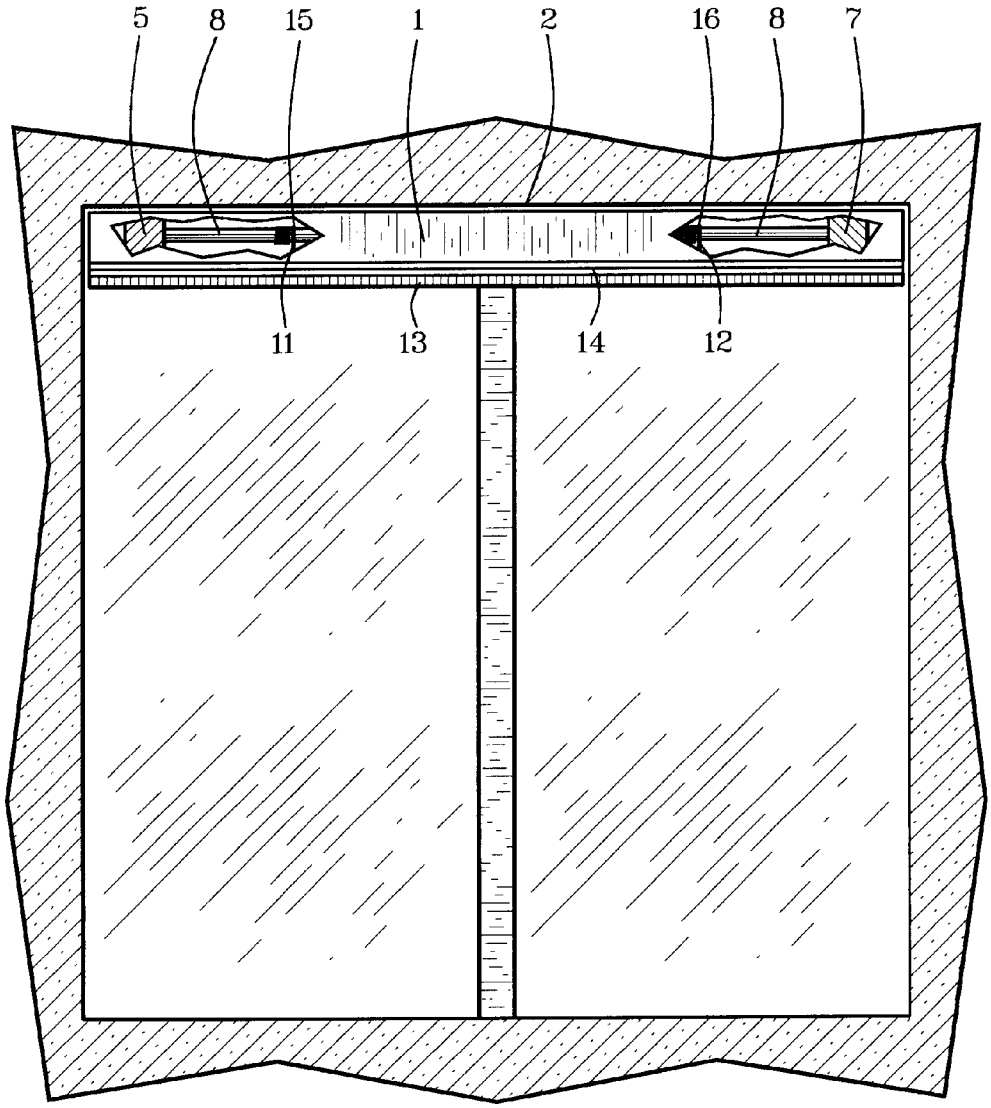
FIG. 2 is the FIG. 1 illustration with the window covering in a raised mode.
Figure 3:
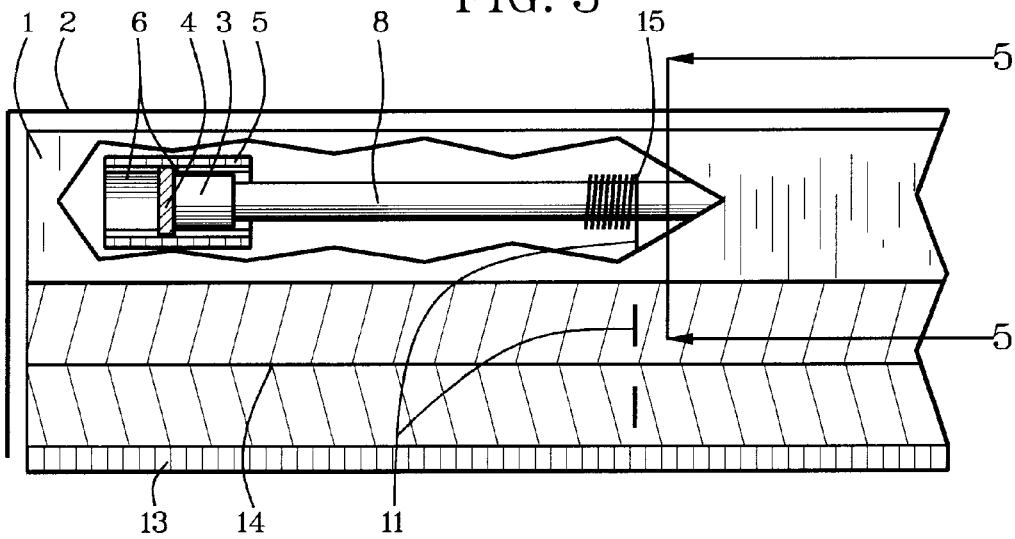
FIG. 3 is an enlarged partially cutaway fragmentary front view of a motor side of the motorized reel system for window covering having a reel that is attached to a reel motor on a motor mount that is slidable linearly in a reel housing.
Figure 4:
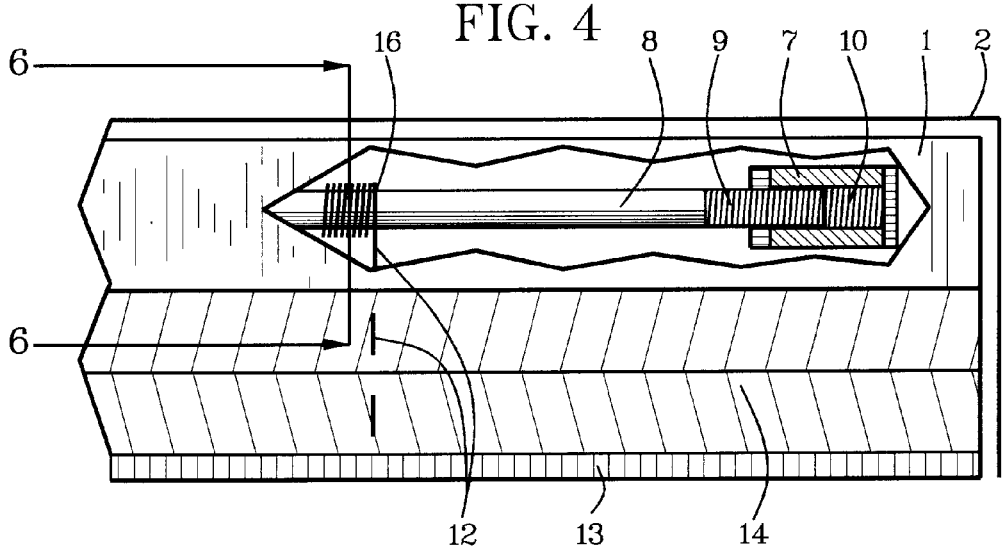
FIG. 4 is an enlarged partially cutaway fragmentary front view of a shaft side of the motorized reel system for window covering with the reel having a second end with predetermined external machine threads and a shaft housing having internal machine threads in which the external machine threads of the second of the reel are rotated for rotating and sliding the reel simultaneously.

Listed numerically below with reference to the drawings are terms used to describe features of this invention. These terms and numbers assigned to them designate the same features throughout this description.

1. Reel-system case
2. Window frame
3. Reel motor
4. Motor mount
5. Reel housing
6. Reel slide
7. Shaft housing
8. Reel
9. External machine threads
10. Internal machine threads
11. First lift line
12. Second lift line
13. Bottom
14. Window covering
15. First line attachment
16. Second line attachment
17. First line guide
18. Second line guide
19. Transverse guide
20. Transverse base
21. Slidable coupling
22. Linear key
23. Front wall
24. Rear wall
25. Keyed motor shaft
26. Reel aperture
27. Reel keyway
28. Reel bearing
29. Threaded sleeve Referring to FIGS. 1–6, a motorized reel system for window covering has a reel-system case 1 with a length for being extended between opposite sides of a window frame 2. A reel motor 3 is positioned on a motor mount 4 proximate a first end of the reel-system case 1. A reel housing 5 has a reel slide 6 on the first end of the reel-system case 1. A shaft housing 7 is positioned on a second end of the reel-system case 1. A reel 8 has at least a line-reel portion that is cylindrical predeterminedly intermediate the reel slide 6 and the shaft housing 7. The reel 8 has a first end that is coupled collinearly too the reel motor 3 and slides linearly in the reel slide 6. For a first embodiment, the reel 8 has a second end with predetermined external machine threads 9. The shaft housing 7 has internal machine threads 10 in which the external machine threads 9 of the second end of the reel 8 are rotated for rotating and sliding the reel 8 simultaneously.

At least one lift line, preferably a first lift line 11 and a second lift line 12, have reel ends that are attached to a line attachment on the reel 8 and lift ends that are attachable to a bottom 13 of a predetermined window covering 14 that is represented by a pleated window covering. The reel end of the first lift line 11 is attached to a first line attachment 15 proximate a predetermined distance from the first end of the reel 8. The reel end of the second lift line 12 is attached to a second line attachment 16 proximate a predetermined distance from the second end of the reel 8.

The lift line, including the first lift line 11 and the second lift line 12, have a line diameter. The external machine thread 9 and the internal machine thread 10 have a thread pitch that is predeterminedly proximate the line diameter of the lift line, such that the reel 8 is caused to travel linearly a distance of the line diameter for each rotation of the reel 8 by the reel motor 3 as depicted by helical line winding proximate the first line attachment 15 and the second line attachment 16.

The real-system case 1 preferably includes a line guide predeterminedly proximate the line attachment. The line guide includes a first line guide 17 predeterminedly proximate the first line attachment 15 and a second line guide 18 predeterminedly proximate the second line attachment 16. The first line guide 17 and the second line guide 18 keep the first lift line 11 and the second lift line 12 in place horizontally for being wound evenly along the reel 8 by screw-threaded linear travel of the reel 8 as it simultaneously travels linearly from-side-to-side and rotates.

Figure 5:
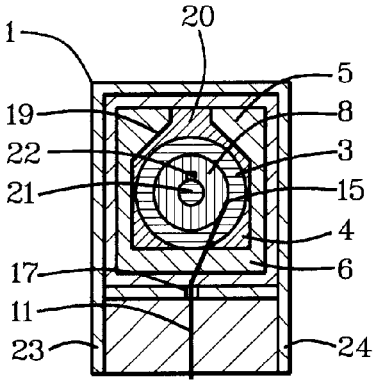
FIG. 5 is a section view as seen from section line 5—5 of FIG. 3 in relation to referenced features.
Figure 6:
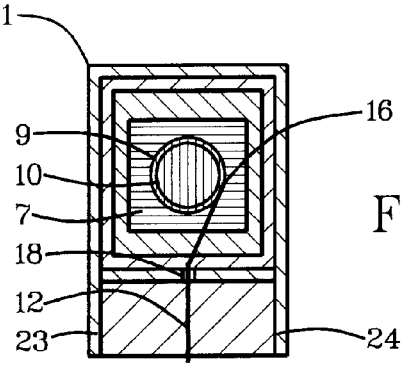
FIG. 6 is a section view as seen from section line 6—6 of FIG. 4 in relation to referenced features.
Figure 7:
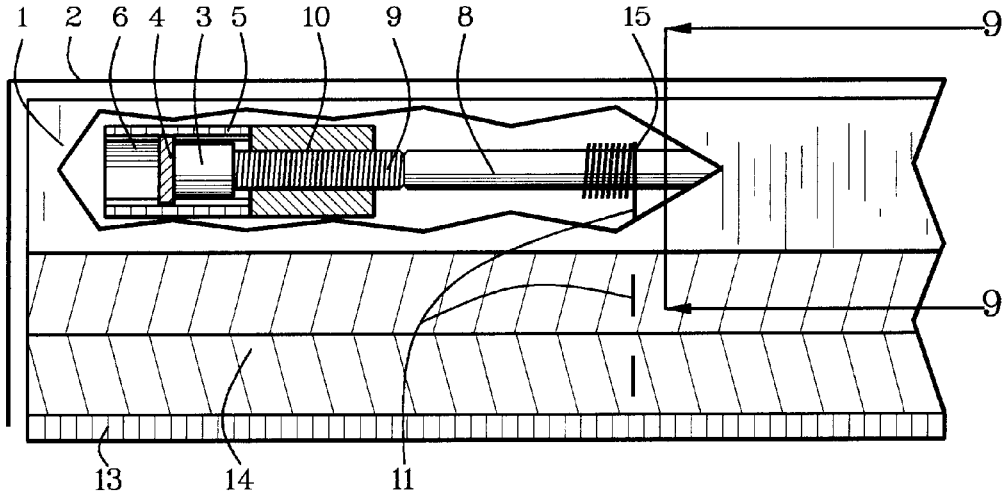
FIG. 7 is an enlarged partially cutaway fragmentary front view of the motor side of the motorized reel system for window covering having a reel housing with internal machine threading in which external machine threading on the first end of the reel is rotated for rotating and linearly sliding the reel simultaneously.
Figure 8:
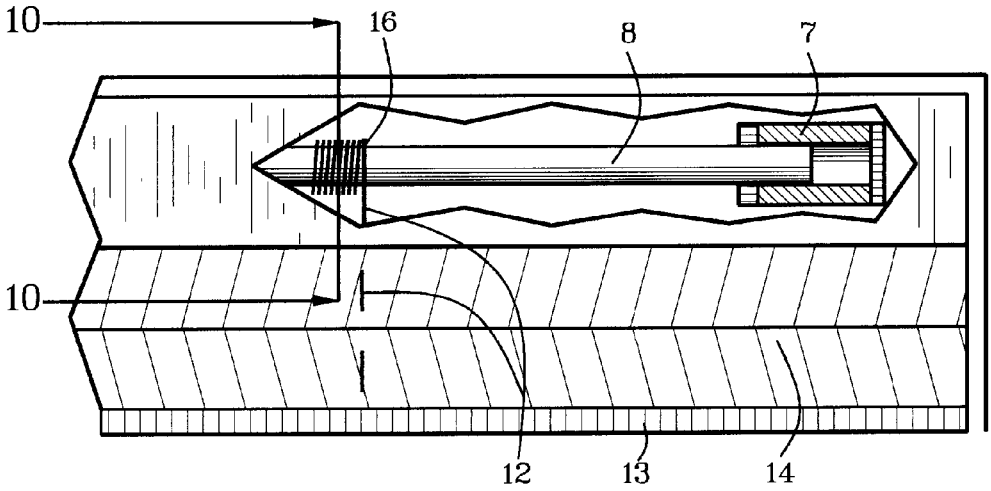
FIG. 8 is an enlarged partially cutaway fragmentary front view of a shaft side of the motorized reel system for window covering with the reel having a second end that slides linearly and rotates in the shaft housing.
Figure 9:
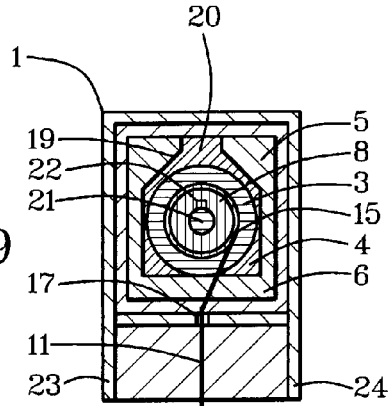
FIG. 9 is a section view as seen from section line 9—9 of FIG. 7 in relation to referenced features.
Figure 10:
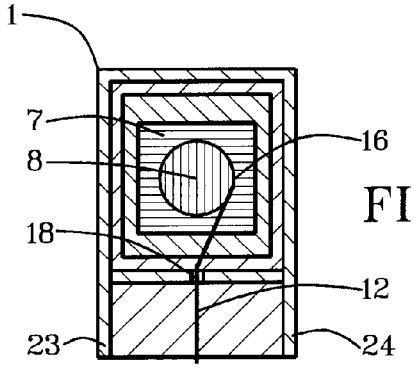
FIG. 10 is a section view as seen from section line 10—10 of FIG. 8 in relation to referenced features.
Figure 11:
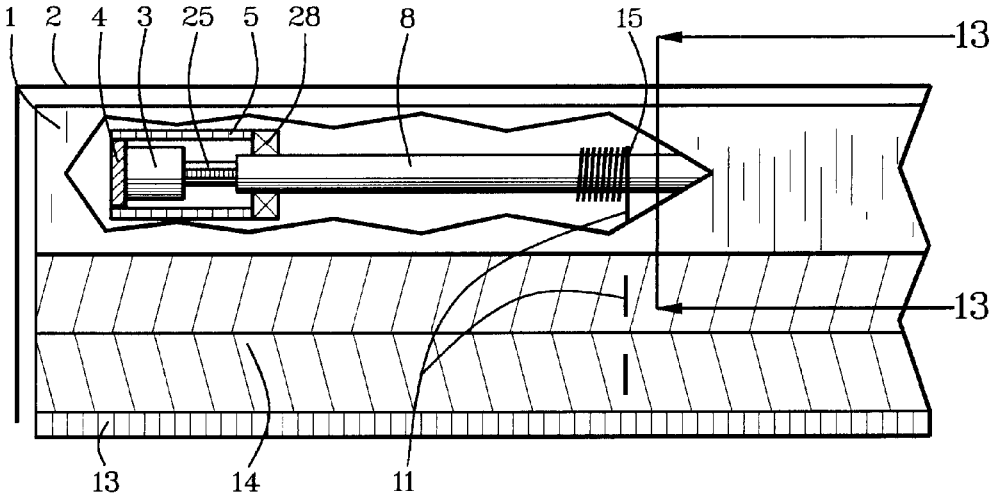
FIG. 11 is an enlarged partially cutaway fragmentary front view of the motor side of the motorized reel system for window covering having the reel coupled slidably to the motor that is attached directly to the reel-system case with the reel being slidable linearly and rotatable simultaneously in the reel housing.
Figure 12:
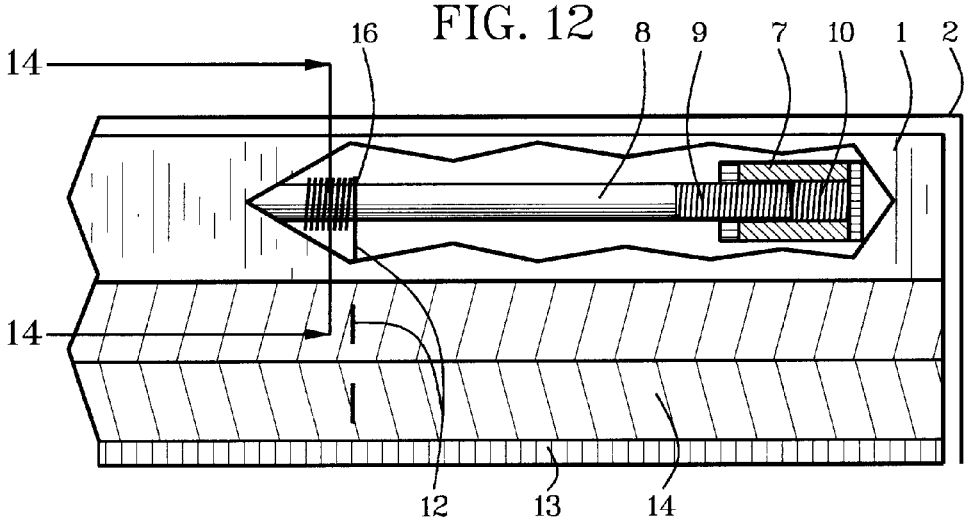
FIG. 12 is an enlarged partially cutaway fragmentary front view of a shaft side of the motorized reel system for window covering with the reel having a second end with predetermined external machine threads and a shaft housing having internal machine threads in which the external machine threads of the second end of the reel are rotated for rotating and sliding the reel simultaneously.
Figure 13:
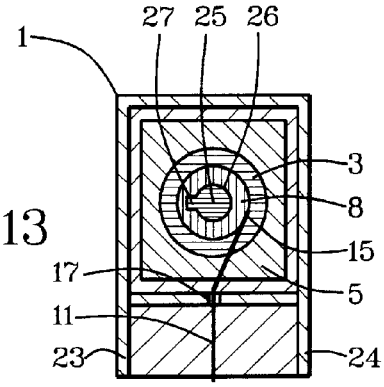
FIG. 13 is a section view as seen from section line 13—13 of FIG. 11 in relation to referenced features.
Figure 14:
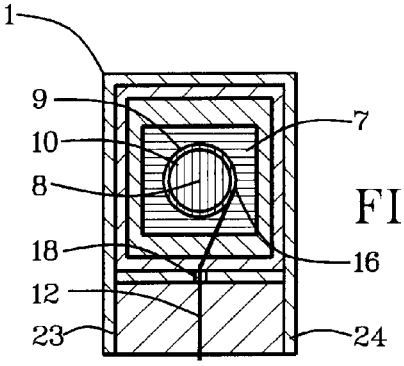
FIG. 14 is a section view as seen from section line 14–114 of FIG. 12 in relation to referenced features.
Figure 15:
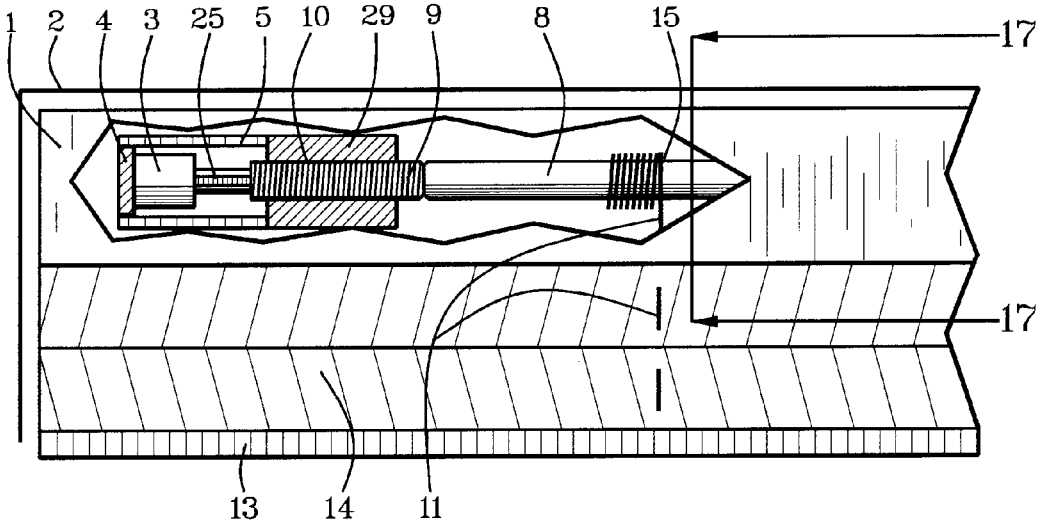
FIG. 15 is an enlarged partially cutaway fragmentary front view of the motor side of the motorized reel system for window covering having the reel coupled slidably to the motor that is attached directly to the reel-system case with the first end of the reel having external machine threads and the reel housing having internal machine threads in which the external machine threads of the first end of the reel are rotated for rotating and sliding the reel simultaneously.
Figure 16:
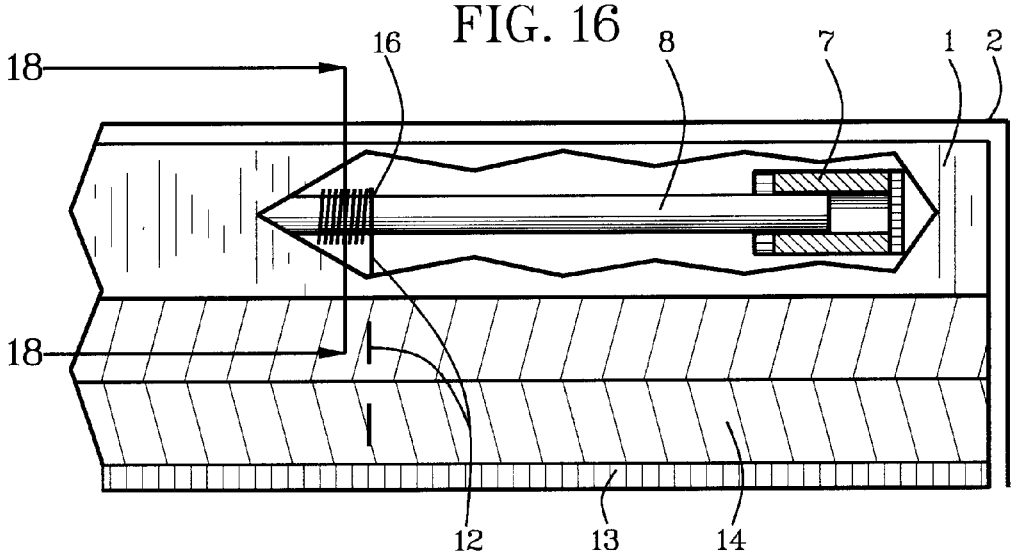
FIG. 16 is an enlarged partially cutaway fragmentary front view of a shaft side of the motorized reel system for window covering with the reel having a second end that slides linearly and rotates simultaneously in the shaft housing.
Figure 17:
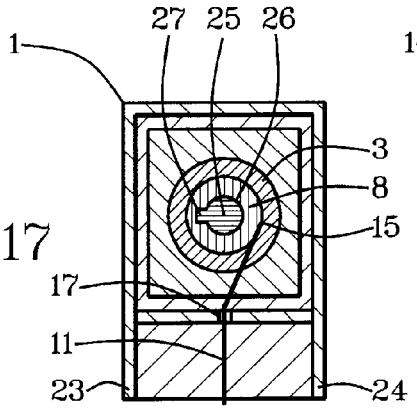
FIG. 17 is a section view as seen from section line 17—17 of FIG. 15 in relation to referenced features.
Figure 18:
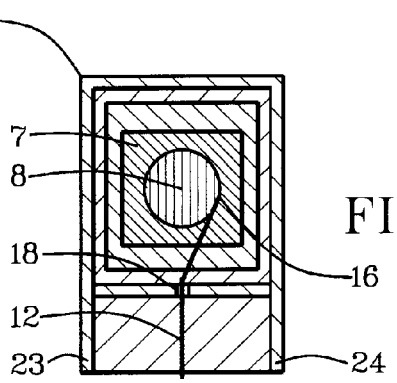
FIG. 18 is a section view as seen from section line 18—18 of FIG. 16 in relation to referenced features.

The reel slide 6 can include a linear enclosure having an internal periphery within which an external periphery of the first end of the reel 8 rotates and slides linearly at the same time. As shown in FIGS. 5 and 9, the linear enclosure can include at least one transverse guide 19 having at least one linear guide surface that is collinear to an axis of the reel 8. The transverse guide 19 includes eccentricity that is not circular in order to arrest rotation of the motor mount 4 in the reel slide 6 as the reel 8 is rotated by the reel motor 3 and reciprocated in linear travel by screw-like rotational action of the external machine threads 9 in contact with the internal machine threads 10.

As depicted in FIG. 5, the motor mount 4 includes a transverse base 20 in sliding contact with the transverse guide 19. The motor mount 4 is slidable linearly in the linear enclosure and the first end of the reel 8 is coupled rigidly to the reel motor 3, such that the motor mount 4 with the reel motor 3 attached to it slides linearly within the linear enclosure and the first end of the reel 8 rotates and also slides linearly within the linear enclosure.

Optionally to the transverse guide 19 and transverse base 20 for arresting rotation of the reel motor 3 and the motor mount 4 while rotating the reel 8, the reel motor 3 can include a slidable coupling 21 having a linear key 22 with which the reel motor 3 is coupled slidably to the reel 8.

The window covering 14 can include a horizontally pleated window shade and the reel-system case 1 can include at least a front wall 23 and preferably also a rear wall 24 that can be articulated to cover the pleated window shade or other window covering 14 in a raised mode.

It is anticipated that most classes of window coverings 14 can be raised and lowered conveniently and without bunching or entanglement with this motorized reel system for window covering 14. The window covering 14 can range from highly ornamental curtains to simple Venetian blinds. Appropriate features for each can be included.

Referring to FIGS. 7–10, optionally, the, external machine threads 9 can be on the first end instead of the second end of the reel 8. In this embodiment, the internal machine threads 10 are in the reel housing 5 or an extension thereof. The second end of the reel 8 travels linearly and rotates in the shaft housing 7. Other features can be as described in relation to FIGS. 1–6.

Referring to FIGS. 11–18, optionally, the reel 8 can be coupled slidably to the reel motor 3 with a slidable coupling intermediate the first end of the reel 8 and the reel motor 3. The slidable coupling can include a keyed motor shaft 25 that is extended from and rotated by the reel motor 3. They keyed motor shaft 25 is slidable in a reel aperture 26 having a reel keyway 27 in the first end of the reel 8. The reel motor 3 is mounted to the motor mount 4 that is attached to the first end, which is a motor end, of the reel-system case 1.

For the embodiment shown in FIGS. 11–14, the second end of the reel 8 has the external machine threads 9 and the shaft housing 7 has the internal machine threads 10. The first end of the reel 8 has an external periphery that is in rotatably and linearly slidable contact with an internal periphery of the reel housing 5. Preferably for this embodiment, the reel housing 5 includes a reel bearing 28 for accommodating the rotatably and linearly slidable contact of the reel 8.

For the embodiment shown in FIGS. 15–18, the first end of the reel 8 has the external machine threads 9 and the reel housing 5 has the internal machine threads 10. Preferably for this embodiment, the reel housing 5 includes a threaded sleeve 29 for accommodating the internal machine threads 10. The second end of the reel 8 is slidable linearly and rotatable in the shaft housing 7.

A new and useful motorized reel system for window covering having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A motorized reel system for window covering comprising:

a reel-system case having a case length for extending predeterminedly intermediate oppositely disposed sides of a window;

a reel motor on a motor mount proximate a first end of the reel-system case;

a reel housing on the first end of the reel-system case;

a shaft housing on a second end of the reel-system case;

a reel having a first end and a second end;

the first end being coupled collinearly to the reel motor;

external threads on a predetermined end of the reel;

internal threads in a threaded housing in which the external threads are rotated;

a reel slide in a bearing housing having an internal periphery in which an external periphery of the reel is in rotational and slidable contact;

the threaded housing being proximate a predetermined end of the reel-system case;

the bearing housing being proximate an end of the reel-system case that is oppositely disposed from the threaded housing; and the threaded housing and the bearing housing being selected predeterminedly from the reel housing and the shaft housing;

wherein the reel and reel motor with motor mount slide linearly within the reel housing.

2. A motorized reel system for window covering comprising:

a reel-system case having a case length for extending predeterminedly intermediate oppositely disposed sides of a window;

a reel motor on a motor mount proximate a first end of the reel-system case;

a reel housing having a reel slide on the first end of the reel-system case;

a shaft housing on a second end of the reel-system case;

a reel having at least a line-reel portion that is cylindrical predeterminedly intermediate the reel slide and the shaft housing;

the reel having a first end that is coupled collinearly to the reel motor and slides linearly in the reel slide;

the reel having a second end with predetermined external threads; and the shaft housing having internal threads in which the external threads of the second end of the reel are rotated for rotating and sliding the reel simultaneously.

3. The motorized reel system for window covering of claim 2 and further comprising:

at least one lift line having a reel end attached to the reel; and the lift line having a lift end attachable to a bottom of a predetermined window covering.

4. The motorized reel system for window covering of claim 2 wherein:

the at least one lift line includes a first lift line having the reel end attached to a first line attachment proximate a predetermined distance from the first end of the reel; and the at least one lift line includes a second lift line having the reel end attached to a second line attachment proximate a predetermined distance from the second end of the reel.

5. The motorized reel system for window covering of claim 2 wherein:

the lift line includes a line diameter;

the external thread of the second end of the reel and the internal thread of the shaft housing have a thread pitch that is predeterminedly proximate the line diameter of the lift line, such that the reel is caused to travel linearly a distance of the line diameter for each rotation of the reel by rotation of the reel motor.

6. The motorized reel system for window covering of claim 2 wherein:

the reel-system case includes a line guide predeterminedly proximate the line attachment.

7. The motorized reel system for window covering of claim 6 wherein:

the line guide includes a first line guide predeterminedly proximate the first line attachment and a second line guide predeterminedly proximate the second line attachment.

8. The motorized reel system for window covering of claim 2 wherein:

the reel slide includes a linear enclosure having an internal periphery within which an external periphery of the first end of the reel rotates and slides linearly.

9. The motorized reel system for window covering of claim 8 wherein:

the internal periphery of the linear enclosure includes at least one transverse guide having at least one linear guide surface that is collinear to an axis of the reel.

10. The motorized reel system for window covering of claim 9 wherein:

the motor mount includes a transverse base in sliding contact with the transverse guide;

the motor mount is slidable linearly in the linear enclosure; and the first end of the reel is coupled rigidly to the reel motor, such that the motor mount with the reel motor attached slides linearly within the linear enclosure and the first end of the reel rotates and slides linearly within the linear enclosure.

11. The motorized reel system for window covering of claim 9 and further comprising:

a reel mount having a transverse base in sliding contact with the transverse guide;

the reel mount having an internal periphery in sliding and rotational contact with an external periphery of the first end of the reel;

the motor mount being attached rigidly to the reel-system case;

the first end of the reel and the reel motor include a slidable coupling with which the reel motor is coupled slidably to the reel.

12. The motorized reel system for window covering of claim 2 wherein:

the window covering includes a horizontally pleated window shade; and the reel-system case includes at least a front wall that is articulated to cover the pleated window shade in a raised mode.

13. A motorized reel system for window covering comprising:

a reel-system case having a case length for extending predeterminedly intermediate oppositely disposed sides of a window;

a reel motor on a motor mount proximate a first end of the reel-system case;

a reel slide on the first end of the reel-system case;

a shaft housing on a second end of the reel-system case;

a reel having at least a line-reel portion that is cylindrical predeterminedly intermediate the reel slide and the shaft housing;

the reel having a first end that is coupled collinearly to the reel motor and the reel slides linearly in the reel slide;

the reel having a second end with predetermined external threads;

the shaft housing having internal threads that match the external threads of the second end of the reel;

at least one lift line having a reel end attached to the reel;

the lift line having a lift end attachable to a bottom of a predetermined window covering;

the at least one lift line includes a first lift line having the reel end attached to a first line attachment proximate a predetermined distance from the first end of the reel;

the at least one lift line includes a second lift line having the reel end attached to a second lift line attachment proximate a predetermined distance from the second end of the reel;

the lift line includes a line diameter; and the external thread of the second end of the reel and the internal thread of the shaft housing have a thread pitch that is predeterminedly proximate the line diameter of the lift line, such that the reel is caused to travel linearly a distance of the line diameter for each rotation of the reel by rotation of the reel motor.

14. The motorized reel system for window covering of claim 13 wherein:

the reel-system case includes a line guide predeterminedly proximate the line attachment.

15. The motorized reel system for window covering of claim 13 wherein:

the line guide includes a first line guide predeterminedly proximate the first line attachment and a second line guide predeterminedly proximate the second line attachment.

16. The motorized reel system for window covering of claim 13 wherein:

the reel slide includes a linear enclosure having an internal periphery within which an external periphery of the first end of the reel rotates and slides linearly.

17. The motorized reel system for window covering of claim 16 wherein:

the internal periphery of the linear enclosure includes at least one transverse guide having at least one linear guide surface that is collinear to an axis of the reel.

18. The motorized reel system for window covering of claim 17 wherein:

the motor mount includes a transverse base in sliding contact with the transverse guide;

the motor mount is slidable linearly in the linear enclosure; and the first end of the reel is coupled rigidly to the reel motor, such that the motor mount with the reel motor attached slides linearly within the linear enclosure and the first end of the reel slides linearly while being rotated within the linear enclosure.

19. The motorized reel system for window covering of claim 17 and further comprising:

a reel mount having a transverse base in sliding contact with the transverse guide;

the reel mount having an internal periphery in sliding and rotational contact with an external periphery of the first end of the reel;

the motor mount being attached rigidly to the reel-system case;

the first end of the reel and the reel motor include a slidable coupling with which the reel motor is coupled slidably to the reel motor, such that the reel mount slides linearly within the linear enclosure while the first end of the reel rotates and slides linearly with the linear enclosure.

20. The motorized reel system for window covering of claim 13 wherein:

the window covering includes a horizontally pleated window shade; and the reel-system case includes a front wall that is articulated to cover the pleated window shade in a raised mode.

21. A motorized reel system for window covering comprising:

a reel-system case having a case length for extending predeterminedly intermediate oppositely disposed sides of a window;

a reel motor on a motor mount proximate a first end of the reel-system case;

a reel housing proximate a first end of the reel-system case;

a shaft housing proximate a second end of the reel-system case;

a reel having a first end and a second end;

a reel coupling intermediate the first end of the reel and a motor shaft of the reel motor;

the reel being coupled slidably to the motor shaft with the reel coupling;

the first end of the reel having predetermined external threads;

the reel housing having internal threads that match the external threads of the first end of the reel; and the second end of the reel having an external periphery that is in rotatably and linearly slidable contact with an internal periphery of the shaft housing;

wherein the reel and reel motor with motor mount slide linearly within the linear enclosure.

22. The motorized reel system for window covering of claim 21 and further comprising:

at least one lift line having a reel end attached to the reel; and the lift line having a lift end that is attachable to a bottom of a predetermined window covering.

23. The motorized reel system for window covering of claim 21 wherein:

the window covering includes a horizontally pleated window shade; and the reel-system case includes a front wall that is articulated to cover the pleated window shade in a raised mode.

24. The motorized reel system for window covering of claim 21 wherein:

the lift line includes a line diameter; and the external thread of the first end of the reel and the internal thread of the reel housing have a thread pitch that is predeterminedly proximate the line diameter of the lift line, such that the reel is caused to travel linearly a distance of the line diameter for each rotation of the reel by rotation of the reel motor.

25. A motorized reel system for window covering comprising:

a reel-system case having a case length for extending predeterminedly intermediate oppositely disposed sides of a window;

a reel motor on a motor mount that is attachable to a first end of the reel-system case;

a reel housing proximate a first end of the reel-system case;

a shaft housing proximate a second end of the reel-system case;

a reel having a first end and a second end;

a slidable coupling intermediate the first end of the reel and the reel motor;

the slidable coupling being a keyed motor shaft that is slidable in a reel aperture having a reel keyway in the first end of the reel;

the reel being coupled slidably to the reel motor with the slidable coupling;

the second end of the reel having predetermined external threads;

the shaft housing having internal threads that match the external threads of the second end of the reel; and the first end of the reel having an external periphery that is in rotatably and linearly slidable contact with an internal periphery of the reel housing;

wherein the reel and reel motor with motor mount slide linearly within the linear enclosure.

26. The motorized reel system for window covering of claim 25 and further comprising:

at least one lift line having a reel end attached to the reel; and the lift line having a lift end that is attachable to a bottom of a predetermined window covering.

27. The motorized reel system for window covering of claim 25 wherein:

the window covering includes a horizontally pleated window shade; and the reel-system case includes a front wall that is articulated to cover the pleated window shade in a raised mode.

28. The motorized reel system for window covering of claim 25 wherein:

the lift line includes a line diameter; and the external thread of the second end of the reel and the internal thread of the shaft housing have a thread pitch that is predeterminedly proximate the line diameter of the lift line, such that the reel is caused to travel linearly a distance of the line diameter for each rotation of the reel by rotation of the reel motor.

29. A motorized reel system for window covering comprising:

a reel-system case having a case length for extending predeterminedly intermediate oppositely disposed sides of a window;

a reel motor on a motor mount that is attachable to a first end of the reel-system case;

a reel housing proximate a first end of the reel-system case;

a shaft housing proximate a second end of the reel-system case;

a reel having a first end and a second end;

a slidable coupling intermediate the first end of the reel and the reel motor;

the slidable coupling being a keyed motor shaft that is slidable in a reel aperture having a reel keyway in the first end of the reel;

the reel being coupled slidably to the reel motor with the slidable coupling;

the first end of the reel having the predetermined external threads;

the reel housing having the internal threads that match the external threads of the first end of the reel; and the second end of the reel having an external periphery that is in rotatably and linearly slidable contact with an internal periphery of the shaft housing;

wherein the reel and reel motor with motor mount slide linearly within the linear enclosure.

30. The motorized reel system for window covering of claim 29 and further comprising:

at least one lift line having a reel end attached to the reel; and the lift line having a lift end that is attachable to a bottom of a predetermined window covering.

31. The motorized reel system for window covering of claim 29 wherein:

the window covering includes a horizontally pleated window shade; and the reel-system case includes a front wall that is articulated to cover the pleated window shade in a raised mode.

32. The motorized reel system for window covering of claim 29 wherein:

the lift line includes a line diameter; and the external thread of the first end of the reel and the internal thread of the reel housing have a thread pitch that is predeterminedly proximate the line diameter of the lift line, such that the reel is caused to travel linearly a distance of the line diameter for each rotation of the reel by rotation of the reel motor.

* * * * *